United States Patent [19]

Rhyan

[11] 4,174,866

[45] Nov. 20, 1979

[54] CARRIER READILY ATTACHABLE TO A SUPPORT

[75] Inventor: William C. Rhyan, Ft. Lauderdale, Fla.

[73] Assignee: Clarke Carrier Corporation, Ft. Lauderdale, Fla.

[21] Appl. No.: 836,715

[22] Filed: Sep. 26, 1977

Related U.S. Application Data

[63] Continuation-in-part of Ser. No. 785,173, Apr. 6, 1977, abandoned.

[51] Int. Cl.[2] ..... A47C 7/62

[52] U.S. Cl. ..... 297/194; 248/210

[58] Field of Search ..... 297/191, 194; 248/311.1, 316, 313, 309, 210, 211; D6/93; D7/70

[56] References Cited

U.S. PATENT DOCUMENTS

| | | | |
|---|---|---|---|
| 2,703,215 | 3/1955 | Weiss | 248/210 |
| 2,837,306 | 6/1958 | Elm | 248/210 |
| 3,008,679 | 11/1961 | Powell | 248/311.1 X |
| 3,068,492 | 12/1962 | Price | 248/311.1 X |
| 3,215,467 | 11/1965 | McFarland et al. | 297/194 |
| 3,367,714 | 2/1968 | Stone | 297/194 |

FOREIGN PATENT DOCUMENTS

| | | | |
|---|---|---|---|
| 1037476 | 9/1953 | France | 297/191 |

*Primary Examiner*—Roy D. Frazier
*Assistant Examiner*—Peter A. Aschenbrenner
*Attorney, Agent, or Firm*—Birch, Stewart, Kolasch & Birch

[57] ABSTRACT

An article support holder for a chair or other suitable structure including a frame which comprises a pair of spaced attaching arms and a member designed to receive and retain an article. A primary attaching arm is designed to be releasably retained on a horizontal arm portion of a chair or any other suitable horizontal support. A secondary arm attaching member is designed to be releasably retained on an adjacent vertical support frame member of the chair or any other suitable vertical support adjacent the horizontal support. The releasably retained portions of the primary arm attaching member and the secondary arm attaching member are orthogonal to each other.

8 Claims, 7 Drawing Figures

CARRIER READILY ATTACHABLE TO A SUPPORT

CROSS-REFERENCE TO RELATED APPLICATIONS

The present application is a continuation-in-part of my copending application Ser. No. 785,173, filed Apr. 6, 1977, now abandoned.

BACKGROUND OF THE INVENTION

1. Field of the Invention

The present invention relates to a device utilized to support an article from a chair, wheelchair or suitable framework which includes both a horizontal support and an additional adjacent vertical support. More particularly, the present invention relates to a container support member which includes a circular holder designed to receive and retain an article such as a cup, glass or can and two arm attaching support members designed to be releasably attached to a horizontal support member and an adjacent vertical support member of a chair, wheelchair or other suitable framework.

2. Description of the Prior Art

Heretofore, article support members designed to receive a cup, glass or can have only included a horizontal arm attaching member. The prior art article support members were primarily intended for use adjacent an automobile window, wherein the door frame would prevent swinging motion. The prior art supports were not adapted for use on the horizontal arm of a chair because the article support had a tendency to rotate about the horizontal arm. The prior art article support members including only a single horizontal attaching arm were found to be particularly unsuitable for use with an invalid chair or wheelchair which normally is designed to include round horizontal supports which enhance the rotation of the article support member.

To provide a support for a paraplegic wheelchair it was the intent of the Petersen patent, U.S. Pat. No. 3,522,887, to provide a horizontal tray that is supported by a means of a vertical flange 6 which includes adjustable members 8 and a second vertical flange 7. The horizontal tray disclosed in the Petersen patent is expensive to manufacture in view of the quantity of material expended and the necessity of providing movable parts.

Another prior art device, U.S. Pat. No. 3,278,148 issued to Denaro, was designed to support a paint container from a rung of a ladder. This support member comprises a bracket 30 which includes a rail and rung attachment structure 82. The container is releasably retained on the bracket 30 by means of the downwardly extending hook 38 and the vertical tabs 60 and 62. It is noted that the rail or vertical support member provides the primary attachment of the container to the ladder. It would not be desirable to use such a container support bracket in combination with an invalid or wheelchair in that supporting a container from the vertical back supporting frame member of the chair would not provide a convenient location for supporting an article relative to a person seated in the chair.

SUMMARY OF THE INVENTION

It is an object of the present invention to provide an improved article support member that is readily attached or detached to both a horizontal support member and a vertical support member of a chair, wheelchair or other suitable framework.

It is an object of the present invention to provide an article support member for a chair that does not incorporate any bolts, screws or other movable parts.

It is an object of the present invention to provide a relatively inexpensive plastic article support member that is specifically designed to releasably retain a cup, glass or can.

A still further object of the present invention is to provide an article support member which when attached to a chair, wheelchair or other suitable framework, is prevented from normally moving either laterally or vertically.

These and other objects of the present invention are fullfilled by constructing an article support member which includes two attaching portions one of which is designed to be releasably attached to the horizontal support and the second is designed to be releasably attached to a vertical support of a chair, wheelchair or other suitable framework. Upon positioning the arm attaching portions on the horizontal and vertical supports the article support member is normally prevented from moving in either the lateral or the vertical direction. Further, the article support is compact in size and may be readily manufactured from plastic. The article support includes a circular portion which is specifically designed to releasably retain a cup, glass or can.

Other objects and further scope of applicability of the present invention will become apparent from the detailed description given hereinafter; it should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
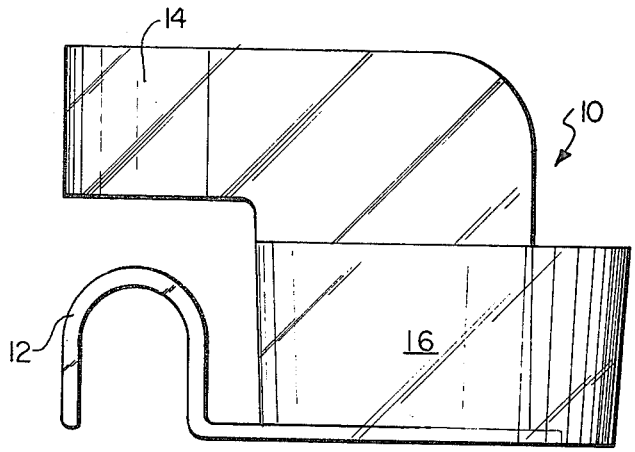
FIG. 1 is a side view of the article support in accordance with the principles of the present invention.

Referring in detail to FIG. 1, there is illustrated an article support member generally indicated by 10, which includes a primary arm attaching member 12 and a secondary arm attaching member 14. An article such as a cup, glass or can may be releasably retained within the article retaining portion 16. A section is removed from the article retaining portion 16 to form an open end which is defined between members 17 and 18.

The primary attaching arm is designed to releasably engage a horizontal support member of a chair, wheelchair or other suitable support. The primary arm attaching portion prevents vertical movement of the article support member. The secondary attaching arm 14 is designed to releasably engage a vertical support frame member of the chair, wheelchair or other suitable support. The secondary attaching arm prevents the lateral movement of the article support member. When the primary attaching arm is mounted on the horizontal support member and the secondary attaching arm is mounted on the vertical support member of a chair, wheelchair or other suitable support, the article retaining portion is then operatively connected for supporting an article.

Figure 2:
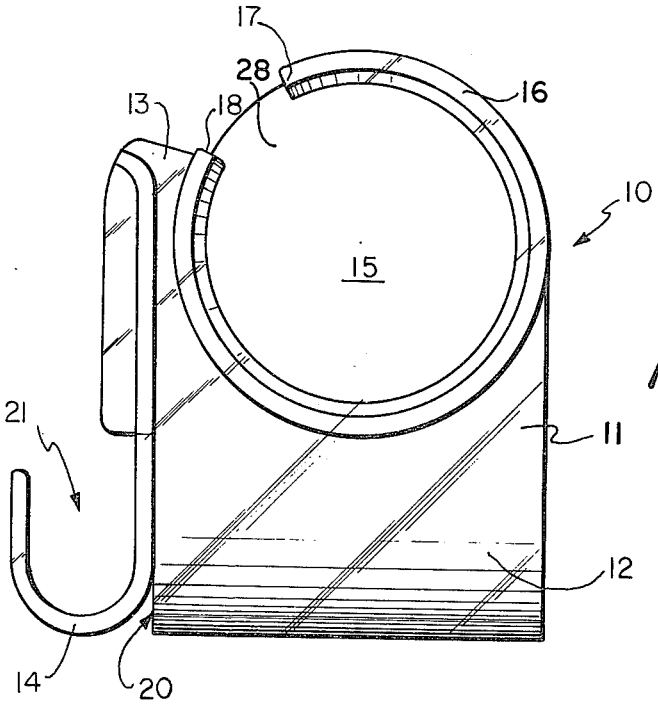
FIG. 2 is a plan view of the present invention as shown in FIG. 1.

Referring in detail to FIG. 2, there is illustrated a plan view of the article supporting member 10 clearly showing the cutaway section defined between members 17 and 18. The primary attaching arm 12 is shown to be directly connected to the article retaining portion 16 by means of the horizontally disposed primary plate member or connection piece 11. The secondary attaching arm 14 is shown to be connected to the article retaining portion 16 by the vertically disposed secondary plate member or connection member 13. The opening 21 of the substantially hooked shaped secondary attaching arm 14 is designed to releasably retain a vertical support frame member of a chair, wheelchair or other suitable support. The open portion 20 of the substantially hooked shaped primary attaching arm 12 is designed to releasably retain a horizontal support member of the chair, wheelchair or other suitable support. It is noted that the opening 21 is orthogonal to the open portion 20, that is, they are offset an an angle of 90 degrees from each other. This offset arrangement of the openings 20 and 21 when attached to the horizontal and vertical support members of a chair, wheelchair or other suitable support provides the necessary framework to support an article from the article retaining portion 16.

Figure 3:
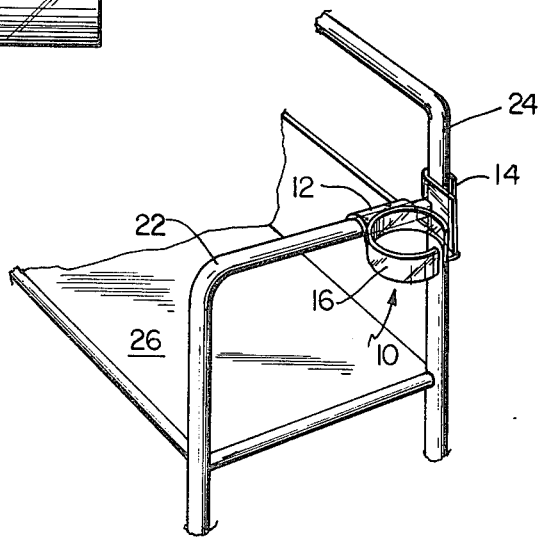
FIG. 3 is a view of the present invention shown attached to the horizontal arm and a vertical support frame members of a chair.

Referring now to FIG. 3, there is shown the article support member 10 with the primary attaching arm 12 releasably retained on the horizontal arm 22 of a chair and the secondary attaching arm 14 releasably retained on a vertical support member 24 of the chair. It is noted that the primary and secondary attaching arms are arranged in such a manner to prohibit any swinging movement of the article support member 10. An article such as a cup, glass or can may be releasably retained within the retaining portion 16. An individual seated in the chair on the seat portion 26 would be quite conveniently situated relative to the article support member 10 to utilize it to releasably retain a cup, glass or can.

Figure 4:
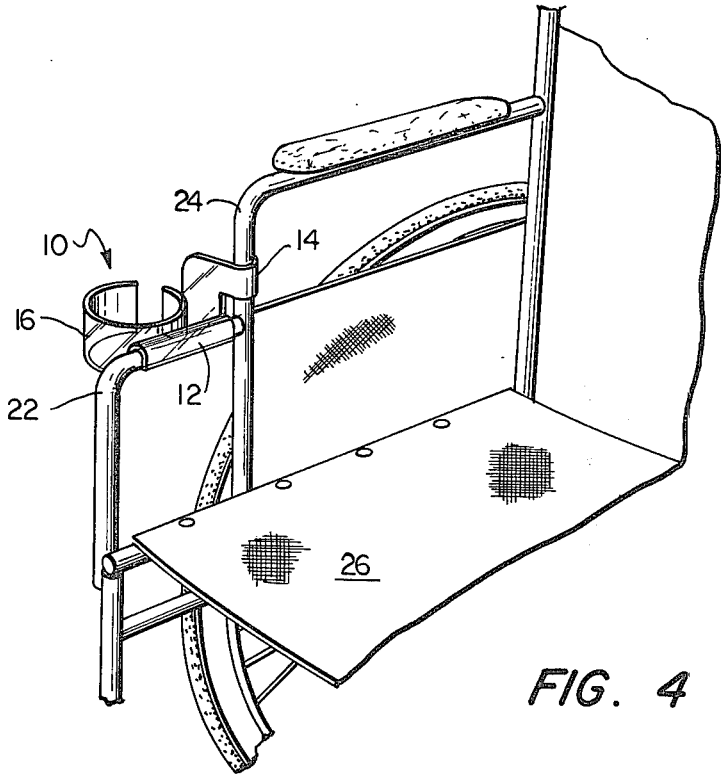
FIG. 4 is a view of the present invention shown attached to a horizontal support member and a vertical support member of a wheelchair.

As previously stated, the primary and secondary attaching arms include openings 20 and 21 which releasably engage horizontal and vertical support members of a chair, wheelchair or other suitable support. A preferred embodiment of the present invention would include circular openings for the openings 20 and 21 with a radius of curvature equal to approximately $\frac{7}{8}$ of an inch. As shown in FIG. 4, such a preferred embodiment is especially designed to snap onto the horizontal and vertical frame support members of an invalid or wheelchair. Constructing the openings to have a radius of curvature equal to approximately $\frac{7}{8}$ of an inch would positively snap the primary and secondary attaching arms to the horizontal and vertical frame support members of an invalid or wheelchair without necessitating the use of any attaching bolts or screws.

Referring now to FIG. 4, there is shown the article support member 10 with the primary attaching arm 12 releasably retained on a horizontal frame member 22 positioned forward of and adjacent to the wheel of an invalid or wheelchair. The secondary attaching arm 14 is releasably retained on a vertical support member 24 of the invalid or wheelchair. It is noted that the primary and secondary attaching arms are arranged in such a manner to prohibit any swinging movement of the article support member 10 relative to the framework of the wheelchair. An article such as a cup, glass or can may be releasably retained within the retaining portion 16. An individual seated in the chair on the seat portion 26 would be quite conveniently situated relative to the article support member 10 to utilize it to releasably retain a cup, glass or can.

As shown in the drawings, the article retaining portion 16 may be designed to include a bottom support 28, shown by dotted lines, on which a cup, glass or can may be positioned. The bottom support 28 may comprise a horizontal member which may be integral with the lower portion of the walls of the circular ring member of the article retaining portion 16. The cutout section between the members 17 and 18 is designed to accommodate a handle portion of an article, such as a cup, when the article is positioned on the bottom support 28.

It is to be understood that the walls of the circular ring member of the article retaining portion 6 are designed to be of a sufficient height to prevent the tipping of an article when the article is positioned on the bottom support 28. The height of the walls of the circular ring member of the article retaining portion 16 is particularly critical when the article support member 10 is positioned on an invalid or wheelchair as shown in FIG. 4. When the article support member 10 is utilized in this fashion the height of the walls must be sufficiently high to prevent the tipping of an article when the invalid or wheelchair is in motion.

Figure 5:
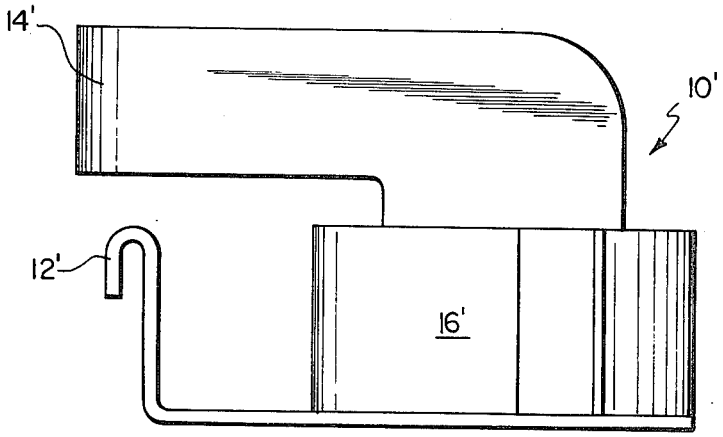
FIG. 5 is a side view of a second embodiment of the present invention.

Referring to FIG. 5, there is illustrated a second embodiment of the present invention. Similar portions of the second embodiment are referred to by the same character with the addition of a prime (′). As shown in FIG. 5, the secondary attaching arm 14′ is essentially the same as the secondary attaching arm 14 as shown in FIG. 1. The primary attaching arm 12′ is shown with a reduced radius of curvature relative to the primary attaching arm 12 as shown in FIG. 1. The article retaining portion 16′ is shown to include an opening and a bottom portion.

Figure 6:
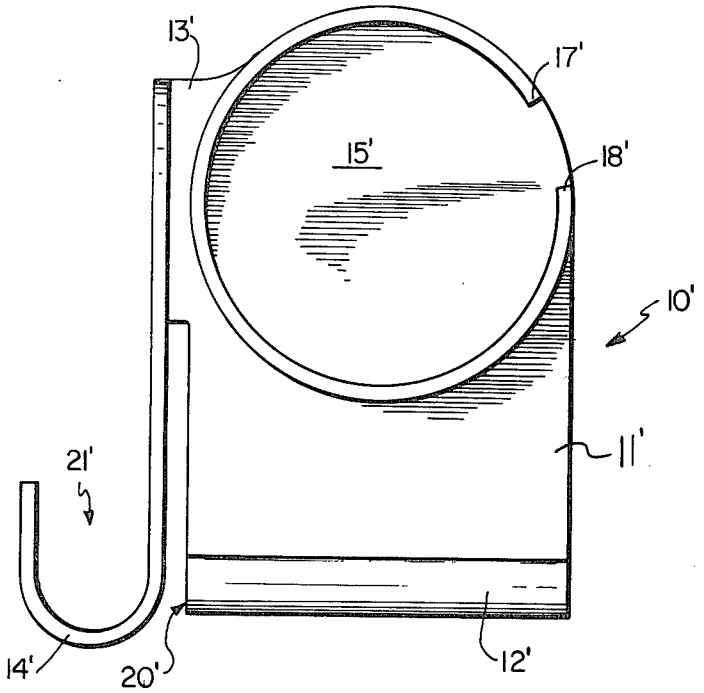
FIG. 6 is a plan view of the second embodiment of the present invention as shown in FIG. 5.

Referring to FIG. 6, there is illustrated a plan view of the article supporting member 10′ clearly showing the cutaway section defined between the members 17′ and 18′. The primary attaching arm 12′ is shown to be directly connected to the article retaining portion 16′ by means of the connecting piece 11′. The secondary attaching arm 14′ is shown to be connected to the article retaining portion 16′ by the connecting member 13′. The opening 21′ of the secondary attaching arm 14′ is designed to releasably retain a vertical support frame member of a chair, wheelchair or other suitable support. The open portion 20′ of the primary attaching arm 12′ is designed to releasably retain a horizontal support member of a chair, wheelchair or other suitable support. It is noted that the opening 21′ is orthogonal to the open portion 20′, that is, they are offset at an angle of 90 degrees from each other. This offset arrangement of the openings 20′ and 21′ when attached to the horizontal and vertical support members of a chair, wheelchair or other suitable support provides the necessary framework to support an article from the article retaining portion 16′.

Figure 7:
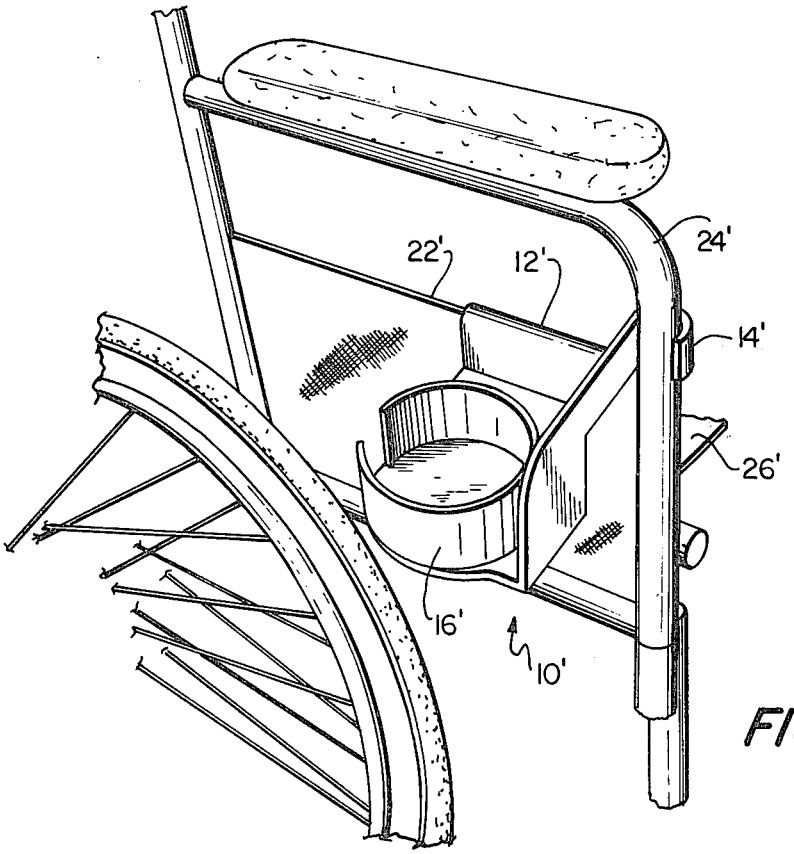
FIG. 7 is a view of the second embodiment of the present invention shown attached to a horizontal support member and a vertical support member of a wheelchair.

Referring in detail to FIG. 7, there is shown the article support member 10′ with the primary attaching arm 12′ releasably retained on the horizontal framework 22′ of a invalid or wheelchair. The secondary attaching arm 14′ is shown to be releasably retained on a vertical support member 24′ of the wheelchair. It is noted that the primary and secondary attaching arms are arranged in such a manner to prohibit any swinging movement of the article support member 10′. An article such as a cup, glass or can may be releasably retained within the retaining portion 16′. An individual seated in the chair on the seat portion 26′ would be quite conveniently situated relative to the article support member 10′ to utilize it to releasably retain a cup, glass or can.

As previously discussed, the height of the walls of the circular ring member of the article retaining portion 16′ are particularly critical when the article support member 10′ is positioned on an invalid or wheelchair as shown in FIG. 7. When the article support member 10′ is utilized in this fashion, the height of the walls must be sufficiently high to prevent the tipping of an article when the invalid or wheelchair is in motion.

In an additional embodiment, the article retaining portion 16 may be designed to include a tapered inner surface which would readily mate with the connical surfaces of a cup or glass. In this embodiment the members 17 and 18, which form the cutout section of the article retaining portion 16, may be biased outwardly to readily accommodate a larger article within the opening 15.

The drawings set forth one embodiment of the present invention which is utilized to be attached to the left hand horizontal and vertical support members of a chair, wheelchair or other suitable support. It is to be understood that the present invention is readily adapted to be positioned on the right horizontal and vertical support members of a chair, wheelchair or other suitable support by rearranging the secondary attaching arm 14 to project from the other side of the article support member 10. Further, while particular reference has been made to attaching the article support member 10 to an invalid or wheelchair, it is to be understood that the device is not limited to attachment to such a chair but may readily be designed to be accomodated on any chair which includes both a horizontal and a vertical support member. In addition, while plastic has been mentioned as a suitable material from which the article support member may be constructed it is to be understood that any material which is moldable, extrudable, stamped or otherwise formed into a suitable article supporting member may be utilized.

In addition, if it is desired to connect the article support member 10 to an invalid or wheelchair it may readily be attached to the portion of the support structure of the chair which is directly forward and slightly below the horizontal arm support member. This portion is usually formed of tubular members which easily accommodate the circular openings 20 and 21 of the primary and secondary attaching arms. By positioning the article support member on this portion of an invalid or wheelchair an article positioned within the article retaining portion is conveniently positioned relative to an individual positioned on the seat portion of the invalid or wheelchair.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An article supporting member adapted to be used with a wheelchair comprising:

an article retaining frame including a substantially circular ring member with an open top and a bottom on which an article may be positioned, said ring member including an upwardly projecting wall being of a height sufficient to prevent the tipping of an article releasably positioned on said bottom support;

said article retaining frame including a primary attaching arm comprising a substantially horizontally disposed primary plate member upon which is secured said ring member, said primary plate member including a substantially hooked attaching member adapted to releasably attach to a horizontally disposed member of a wheelchair;

said article retaining frame further including a secondary attaching arm comprising a substantially vertically disposed secondary plate member secured along another edge of said substantially horizontally disposed primary plate member, said secondary plate member including a substantially hooked attaching member adapted to releasably attach to a vertically disposed member of a wheelchair.

2. An article supporting member as defined in claim 1, wherein said substantially hooked attaching member of said primary attaching arm and said substantially hooked attaching member of said secondary attaching arm are orthogonally disposed.

3. An article supporting member as defined in claim 1, wherein the article retaining frame, the primary attaching arm and the secondary attaching arm are integrally formed with each other.

4. An article supporting member as defined in claim 1, wherein the primary attaching arm is adjacent to the article retaining ring member and the secondary attaching arm is vertically offset from the article retaining open portion.

5. An article supporting member as defined in claim 1, wherein the substantially circular ring member is formed with a cutaway section.

6. An article supporting member as defined in claim 1, wherein said substantially hooked attaching member of said primary attaching arm is an elongated slot in cross section whereas said substantially hooked attaching member of said secondary attaching arm is substantially semi-circular in cross section.

7. An article supporting member as defined in claim 6, wherein said elongated slot of said substantially hooked attaching member of said primary attaching arm is resilient to accommodate various thicknesses of horizontal support members of a wheelchair.

8. An article supporting member as defined in claim 1, wherein said substantially hooked attaching members are substantially semi-circular in cross section which releasably attach to tubular support members of a wheelchair.

* * * * *